US010049798B2

(12) United States Patent
Sweeney

(10) Patent No.: US 10,049,798 B2
(45) Date of Patent: Aug. 14, 2018

(54) HIGH RESISTIVITY MAGNETIC MATERIALS

(71) Applicant: General Electric Company, Schenectady, NY (US)

(72) Inventor: Sean Michael Sweeney, Schenectady, NY (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 319 days.

(21) Appl. No.: 14/751,307

(22) Filed: Jun. 26, 2015

(65) Prior Publication Data

US 2015/0294772 A1 Oct. 15, 2015

Related U.S. Application Data

(62) Division of application No. 13/220,737, filed on Aug. 30, 2011, now Pat. No. 9,147,524.

(51) Int. Cl.

| | |
|---|---|
| ***H01F 7/02*** | (2006.01) |
| ***H01F 1/057*** | (2006.01) |
| ***H01F 41/02*** | (2006.01) |
| ***H01F 10/12*** | (2006.01) |

(52) U.S. Cl.

CPC ..... *H01F 1/0577* (2013.01); *H01F 10/126* (2013.01); *H01F 41/0266* (2013.01)

(58) Field of Classification Search

None

See application file for complete search history.

(56) References Cited

U.S. PATENT DOCUMENTS

| | | | |
|---|---|---|---|
| 392,519 | A | 11/1888 | McGill |
| 4,612,047 | A | 9/1986 | Schmidt et al. |
| 4,762,574 | A | 8/1988 | Ghandehari |
| 4,891,078 | A | 1/1990 | Ghandehari |
| 5,858,124 | A | 1/1999 | Endo et al. |
| 6,309,441 | B1 | 10/2001 | Benz et al. |
| 6,984,271 | B2 | 1/2006 | Tayu et al. |
| 7,455,951 | B2 | 11/2008 | Ichihara et al. |
| 7,488,395 | B2 | 2/2009 | Nakamura et al. |
| 7,972,450 | B2 | 7/2011 | Komuro et al. |
| 2002/0023583 | A1 | 2/2002 | Kumokita et al. |

(Continued)

FOREIGN PATENT DOCUMENTS

| | | | |
|---|---|---|---|
| EP | 1737001 | A2 | 12/2006 |
| JP | 5121220 | A | 5/1993 |

(Continued)

OTHER PUBLICATIONS

Machine translation of JP2001068317, Mar. 2001.*

(Continued)

*Primary Examiner* — Xiaowei Su

(74) *Attorney, Agent, or Firm* — GE Global Patent Operation; John Darling

(57) ABSTRACT

A magnet is disclosed. The magnet includes a plurality of layers such that a first layer includes a ferromagnetic material comprising iron and a rare earth element; and a second layer includes an alkaline earth metal fluoride and a rare earth oxide. A method of preparing a magnet and an article including the magnet are disclosed. The method includes disposing a first layer including a ferromagnetic material and disposing a second layer over the first layer.

14 Claims, 1 Drawing Sheet

(56) References Cited

U.S. PATENT DOCUMENTS

| | | | | |
|---|---|---|---|---|
| 2002/0064010 | A1 | 5/2002 | Nelson et al. | |
| 2002/0112785 | A1 | 8/2002 | Sekine et al. | |
| 2004/0000359 | A1 | 1/2004 | Tayu et al. | |
| 2005/0012231 | A1 | 1/2005 | Olsson et al. | |
| 2005/0133117 | A1 | 6/2005 | Tayu et al. | |
| 2006/0213585 | A1 | 9/2006 | Nakamura et al. | |
| 2007/0144615 | A1 | 6/2007 | Komuro et al. | |
| 2010/0243946 | A1 | 9/2010 | Johnson et al. | |
| 2011/0200839 | A1* | 8/2011 | Marinescu | B82Y 25/00 428/611 |

FOREIGN PATENT DOCUMENTS

| | | | | | |
|---|---|---|---|---|---|
| JP | 6069009 | A | | 3/1994 | |
| JP | H09186010 | A | | 7/1997 | |
| JP | 10163055 | A | | 6/1998 | |
| JP | 10321427 | A | | 12/1998 | |
| JP | 2000082610 | A | | 3/2000 | |
| JP | 2001068317 | A | * | 3/2001 | H01F 1/0577 |
| JP | 2003022905 | A | | 1/2003 | |

OTHER PUBLICATIONS

Marc T Thompson, "Practical Issues in the Use of NdFeB Permanent Magnets in Maglev, Motors, Bearings,and Eddy Current Brakes", Proceedings of the IEEE, Nov. 2009, vol. 97, No. 11, 10 pages.

Jinfang Liu, "High Performance Permanent Magnets for Advanced Motors", Electron Energy Corporation, Downloaded from the Internet :<http://www1.eere.energy.gov/vehiclesandfuels/pdfs/merit_review_2010/power_electronics/ape031_liu_2010_p.pdf on Aug. 25, 2011, Jun. 10, 2010, 15 pages.

* cited by examiner

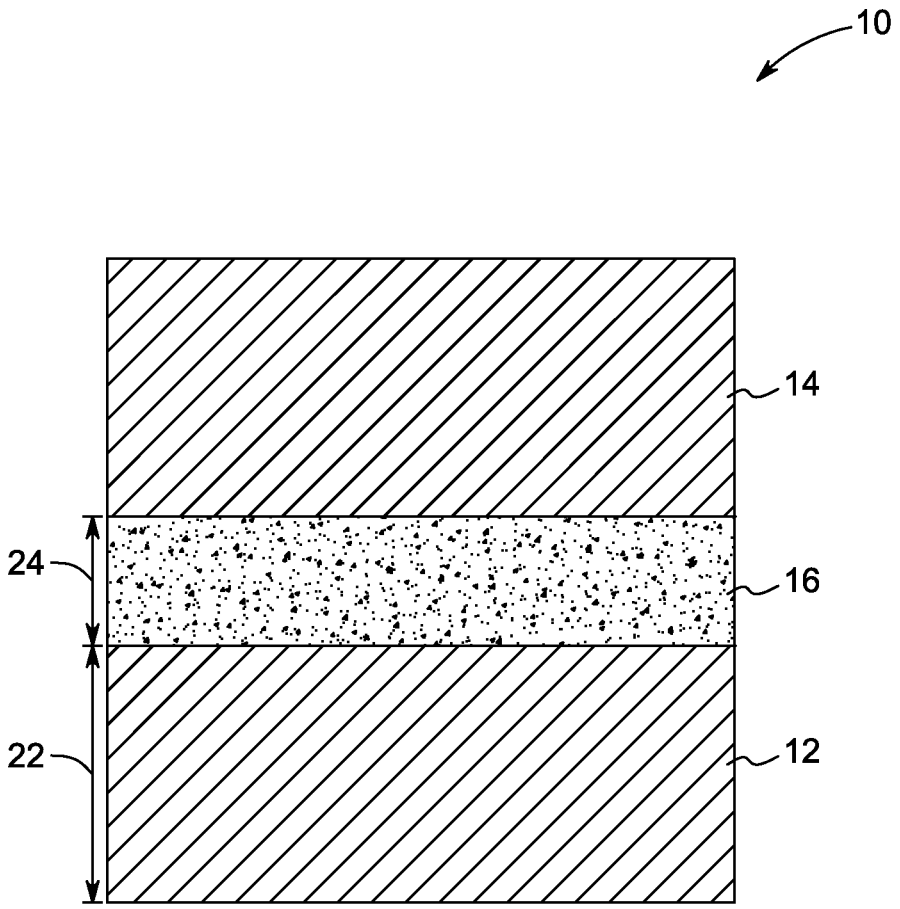
10
14
24
16
22
12

HIGH RESISTIVITY MAGNETIC MATERIALS

CROSS REFERENCE TO RELATED APPLICATIONS

This application is a divisional of U.S. patent application Ser. No. 13/220,737, titled "HIGH RESISTIVITY MAGNETIC MATERIALS," filed on 30 Aug. 2011, which is herein incorporated by reference.

BACKGROUND

The invention relates generally to high resistivity magnetic materials, and, in particular, to permanent magnetic materials with high resistivity.

Development of cost effective electrical machines faces challenges of power density and fuel efficiency. Current machine technologies suffer from high stator core and rotor magnet losses due to their high speeds and winding structures. Attempts to design efficient stators and rotors to mitigate the above losses often result in an increase in complexity of their design, which in turn, makes electrical machines incorporating such designs commercially unattractive.

The thrust to develop fuel efficient machines, for instance, for use in hybrid automobiles, will have to be tempered with a cost of manufacturing such machines. Any machine technology that achieves energy efficiency at an undue manufacturing cost will likely not be commercially viable.

An electrical machine having a level of efficiency that is enhanced over currently available electrical machines and that can be manufactured in a cost-efficient manner would be highly desirable.

BRIEF DESCRIPTION

Briefly, in one embodiment, a magnet is disclosed. The magnet includes a plurality of layers such that a first layer includes a ferromagnetic material comprising iron and a rare earth element; and a second layer includes an alkaline earth metal fluoride and a rare earth oxide.

In one embodiment, a magnet is disclosed. The magnet includes a plurality of layers including a plurality of repeating units. The unit includes a first layer and a second layer, such that the first layer includes a ferromagnetic material comprising iron and a rare earth element; and the second layer includes an alkaline earth metal fluoride and a rare earth oxide.

In one embodiment, a method of preparing a magnet is disclosed. The method includes disposing a first layer including a ferromagnetic material and disposing a second layer over the first layer. The ferromagnetic material of the first layer includes iron and a rare earth element; and the second layer includes an alkaline earth metal fluoride and a rare earth oxide.

DRAWINGS

These and other features, aspects, and advantages of the present invention will become better understood when the following detailed description is read with reference to the accompanying drawing, wherein:

FIG. 1 is a schematic view of a magnet with multiple layers, in accordance with one embodiment of the invention.

DETAILED DESCRIPTION

Embodiments of the present invention are directed towards permanent magnetic materials and methods of preparing.

In the following description and the claims that follow, whenever a particular aspect or feature of an embodiment of the invention is said to comprise or consist of at least one element of a group and combinations thereof, it is understood that the aspect or feature may comprise or consist of any of the elements of the group, either individually or in combination with any of the other elements of that group. Similarly, the singular forms "a", "an" and "the" include plural referents unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "about" may not be limited to the precise value specified, and may include values that differ from the specified value. In at least some instances, the approximating language may correspond to the precision of an instrument for measuring the value. In the present discussions it is to be understood that, unless explicitly stated otherwise, any range of numbers stated during a discussion of any region within, or physical characteristic of, is inclusive of the stated end points of the range.

As used herein, the term "adjacent," when used in the context of discussion of different entities, for instance, layers, may refer to the situation where the entities under discussion are disposed immediately next to each other, that is, are contiguous, or it may also refer to a situation wherein intervening entities are disposed between the entities under discussion, that is, the entities under discussion are non-contiguous.

In accordance with an embodiment of the invention, a magnet is disclosed. In one embodiment, the magnet is a permanent magnet (PM). In one embodiment, the permanent magnet includes at least one rare earth metal. Permanent magnets containing rare-earth metals (e.g., neodymium or Nd) are employed in computers, motors, generators, automobiles, wind turbines or windmills, laboratory equipment, medical systems, and other equipment and devices. Certain devices employing permanent magnets may be exposed to a working environment having high temperatures (e.g., greater than 80° C.). The permanent magnet (PM) material component of these devices should be able to provide an adequate magnetic field (e.g., at the working area/gap) within the expected working temperature range. In meeting this need, the PM material should retain its particular magnetic properties, such as remanence and coercivity, at sufficient levels when exposed to the expected higher temperatures. Such retention of magnetic properties may be beneficial when these devices are operating normally or in allowable failure conditions.

Generally, PM material capable of working at high temperature (e.g., greater than 80° C., 100° C., etc.) may be called high-temperature permanent magnets (HTPMs). An example of commercially available HTPMs is high-coercivity neodymium-iron-boron (NdFeB) magnets which are typically a more economical alternative to the other HTPMs, such as aluminum nickel cobalt (AlNiCo) magnets and samarium cobalt (SmCo) magnets. Advantageously, NdFeB magnets generally possess a higher energy product than AlNiCo and SmCo magnets.

Non-limiting examples of magnets include high resistivity magnetic materials having a magnetic phase and a non-conductive phase. In one embodiment of the invention, the high resistivity magnetic material has a resistivity of at least about 150 micro ohm centimeters, and an energy product of at least about 35 mega Gauss Oersted (MGOe).

In one embodiment of the invention, high resistivity magnetic materials may be realized from magnetic materials that have undergone suitable processing. The use of high resistivity nanostructured magnets helps to reduce eddy current losses of the electric machines. Non-limiting examples of high resistivity hard magnetic material include ferrites and borides. It will be advantageous to develop high resistivity magnetic materials and magnets without increasing manufacturing cost.

One embodiment of this invention involves forming and using a magnet having low eddy current losses by developing electrically resistive interlayers of magnetic materials by co-sintering to reduce manufacturing cost. In one embodiment, an article including the magnet is provided. In one embodiment, the article using the magnet is a motor or generator.

In one embodiment, the magnet includes a plurality of layers including a first layer and a second layer. The first layer includes a ferromagnetic layer that includes iron and at least one rare earth element. The rare earth element may be selected from the group consisting of gadolinium, terbium, erbium, dysprosium, scandium, yttrium, lanthanum, praseodymium, samarium, europium, holmium, thulium, ytterbium, lutetium, and neodymium. In one embodiment, the rare earth element comprises neodymium. In a further embodiment, the rare earth element is neodymium. In one embodiment, the ferromagnetic layer comprises a boride material. In one specific embodiment, the ferromagnetic layer comprises neodymium iron boride (NdFeB).

In one embodiment, the ferromagnetic layer includes iron and a combination of rare earth elements. In one embodiment, the rare earth part of the ferromagnetic layer comprises neodymium and another material selected from the group consisting of gadolinium, terbium, erbium, dysprosium, scandium, yttrium, lanthanum, praseodymium, samarium, europium, holmium, thulium, ytterbium, and lutetium. In one embodiment, cobalt (Co) or other elements may replace a portion of the iron (Fe) in the NdFeB, for example, to increase the Curie temperature and to further improve the thermal stability of the magnet prepared by using NdFeB. The Curie temperature (Tc) is generally the temperature at which the parallel alignment of elementary magnet moments dissipates, and the material does not hold its magnetization.

It is desirable to obtain a magnet including NdFeB magnetic material ("NdFeB magnet"), at low manufacturing cost and that shows low eddy current losses. This is traditionally achieved by making the NdFeB more electrically resistive by attempting to put an electrically resistive layer at grain boundaries in the microstructure. More often than not, this electrically resistive layer ends up not forming a contiguous layer at grain boundaries, and thus is not highly effective in dramatically increasing electrical resistivity. In one embodiment of the present invention, macroscopic electrically resistive layers are introduced as a second layer into the magnet.

In one embodiment of the invention, the second layer comprises an alkaline earth metal fluoride and a rare earth oxide. The alkaline earth metal may be selected from the group consisting of calcium, barium, and strontium. In a particular embodiment, the alkali metal comprises calcium. In another embodiment of the invention, the alkaline earth metal may be a combination of two or more elements selected from the above mentioned group. In a specific embodiment, the alkali metal fluoride is calcium fluoride ($CaF_2$).

The rare earth element of the rare earth oxide of the second layer may be selected from the group consisting of gadolinium, terbium, erbium, dysprosium, scandium, yttrium, lanthanum, praseodymium, samarium, europium, holmium, thulium, ytterbium, lutetium, and neodymium. The rare earth oxide may comprise one or more of the rare earth elements. In one embodiment, the rare earth oxide comprises neodymium. In one embodiment, the rare earth oxide comprises yttrium. In one specific embodiment, the rare earth oxide comprises yttrium oxide ($Y_2O_3$).

In one embodiment, the magnet comprises the alkaline earth metal fluoride in a range from about 0.1 volume percent to about 80 volume percent of the second layer. In one embodiment, the alkaline earth metal fluoride is in the range from about 5 volume percent to about 60 volume percent. In one embodiment, the alkaline earth metal fluoride is in the range from about 10 volume percent to about 40 volume percent.

In one embodiment of the invention, the magnet comprises a plurality of first and second layers such that the magnet comprises a plurality of repeating units, each unit including a first layer and a second layer. In one embodiment, the first layer of a unit is adjacent to the second layer of the adjacent repeating unit. In one embodiment, the first layer and the second layer of each repeating unit are contiguous. In a further embodiment, the second layer of a repeating unit is contiguous to the first layer of an adjacent repeating unit. In one embodiment of the invention, there are at least three repeating units having the ferromagnetic first layer and a second layer including alkaline earth metal fluoride and a rare earth oxide.

FIG. 1 schematically depicts a non-limiting embodiment of a magnet 10. The magnet 10 includes layers 12 (having a thickness 22) and 14. Each of the layers 12 and 14 independently include at least one ferromagnetic material. The magnet 10 further includes a resistive layer 16 having thickness 24 disposed so that it is "sandwiched" between the layers 12 and 14. In one particular embodiment of the invention, the first layer comprises NdFeB and the second layer comprises a mixture of $CaF_2$ and $Y_2O_3$.

In one embodiment, the thickness of the ferromagnetic layer 12, 14 is greater than about 1 mm. In an embodiment, the thickness 22 of the first layer 12 is in the range from about 1 mm to about 12 mm. In a particular embodiment, the thickness 22 of the ferromagnetic layer 12 is in the range from about 2 mm to about 5 mm.

In one embodiment, the thickness 24 of the second layer 16 is less than about 500 microns. In one embodiment, the thickness 24 of the second layer 16 is in the range from about 50 micrometers to about 200 micrometers. In one specific embodiment, the thickness 24 of the second layer 16 is about 100 micrometers.

In one embodiment, a method of preparing a magnet is disclosed. The method includes disposing the first layer 12 and second layer 14 and forming the magnet. In accordance with an embodiment of the invention, the method to make the magnet includes disposing at least one ferromagnetic layer 12 and at least one resistive layer 16 adjacent to each other to obtain a multilayer. Disposing the first layer 12 and second layer 16 may respectively include disposing powders, slurry, or paste comprising the respective layer materials.

In one embodiment, powders of the ferromagnetic materials and resistive layer materials are used to form layers and, and the layers of powder are then consolidated to form a green body of the multilayer magnet. Non-limiting examples of techniques that may be used for consolidating the multilayer include uniaxial compressing, isostatic compressing, hot isostatic compressing, die upset compressing, or spark plasma sintering.

In one embodiment, the green body is sintered to obtain the magnet. During sintering of the green body of the magnet, the ferromagnetic layer and the resistive layers are co-sintered to a temperature that is suitable to densify the magnet. The density of the magnet desired for different applications may be different. The sintering temperature necessary for obtaining a particular density and physical strength may vary greatly with respect to the constituent materials of the magnet.

In one embodiment, the ferromagnetic layer 12 of the magnet includes iron and a rare earth element. In one embodiment, the ferromagnetic layer 12 comprises a boride material. In one specific embodiment, the ferromagnetic layer 12 comprises neodymium iron boride (NdFeB).

In one embodiment, the resistive layer 16 includes an alkaline earth metal fluoride and a rare earth oxide. In a particular embodiment, the alkaline earth metal of the second layer 16 comprises calcium. In one embodiment, the rare earth oxide comprises yttrium. In one embodiment, the alkaline earth metal comprises calcium fluoride ($CaF_2$) and rare earth oxide comprises yttrium oxide ($Y_2O_3$). In one specific embodiment, the second layer 16 comprises a mixture of $CaF_2$ and $Y_2O_3$.

Earlier attempts using co-sintering to form electrically insulating interlayers in a magnetic material, such as $CaF_2$ with samarium cobalt magnets, met with limited success. This was likely due to the formation of non-uniform layers of $CaF_2$, allowing an electrically conductive path of magnet material across them. The requirements of low cost, matched sintering and thermal expansion properties between insulator and magnet, present significant materials selection challenges. Others have tried coating magnet powders with an electrically insulative material and then sintering the powders to create a dense magnet with grain boundary regions that are electrically insulating. The amount of electrical resistivity obtained in this way has been limited, likely due to difficulties obtaining uniform and contiguous coverage of grain boundaries with electrically insulating material.

Certain properties, if displayed by a permanent magnetic material, render it suitable for the purposes of fabricating a high resistivity permanent magnetic material according to embodiments of the present invention. A non-limiting example of such a property is the chemical reactivity of the hard magnetic material with the selected resistive material. This property is relevant during, for instance, the sintering step of the multilayer. Considering as a non-limiting example, when a layer of a powder of a magnetic material is disposed in close proximity to a layer of a powder of resistive material, it may be advantageous that the powder of the magnetic material does not substantially chemically react with the layer of resistive material during sintering.

Further, the respective thermal expansion coefficients of the magnetic first layer 12 and resistive second layer 16 materials are desirably accommodative of each other to produce a layered structure with sufficiently low levels of cracking so that the resultant structure can be used in electrical motor applications. In one embodiment of the invention, the sintering is performed within a temperature range from about 900° C. to about 1200° C. In one embodiment of the invention, the sintering is performed for time duration of up to about 24 hours. When cooling from these sintering temperatures, the strain mismatch that can develop between layers with significantly varying coefficient of thermal expansion may be sufficient to cause cracking in one or more of the layers. Therefore, it is desirable to have accommodative coefficient of thermal expansion (CTE) of the resistive layer materials.

Generally, when a neodymium (Nd) compound and an oxide are sintered together at elevated temperatures, the highly reactive Nd metal atoms chemically react with and reduce the oxides.

However, this reaction can be reduced, to a certain extent, by proper combination of the oxide materials of the resistive layer 16 by using the chemical properties of the resistive layer 16 materials. For example, a mixture of $Y_2O_3$ and $SiO_2$ may be used as a resistive interlayer 16. In this instance, the $Y_2O_3$ by itself would get infiltrated by electrically conducting melt from NdFeB during sintering, but the $SiO_2$ gets de-oxidized by the melt and the melt gets oxidized to a solid, thus limiting its infiltration into the interlayer. This method may be used to make well bonded, electrically insulating interlayers in the magnet. However, care needs to be taken to adapt mismatching between the densification rate of the oxidized solid and the magnetic layer as otherwise the mismatch may lead to crack formation in the interlayers.

The material and/or method used in an embodiment of the present invention circumvent the Nd infiltration into the oxide layer. In the presence of $CaF_2$, an oxide material, such as for example $Y_2O_3$, does not get infiltrated by an Nd-containing liquid phase during sintering. As put forward earlier, $CaF_2$ has a relatively higher CTE than NdFeB, and this may not permit a co-sintering approach to prepare the layered magnetic structure with the second layer made up of only $CaF_2$. However, in one embodiment of the invention, the second layer comprises a mixture of $CaF_2$ and $Y_2O_3$. $Y_2O_3$ has a much lower thermal expansion than $CaF_2$; therefore, when a resistive layer comprising a combination of $CaF_2$ and $Y_2O_3$ is provided in between the ferromagnetic layers 12, 14 comprising neodymium, the disadvantages of higher thermal expansion of $CaF_2$ are reduced by the $Y_2O_3$. Moreover the neodymium infiltration problem is mitigated by the presence of $CaF_2$. In one embodiment, the $CaF_2$ present in the resistive layer is less than about 50 volume % of the resistive layer.

While the variations and additions in the proposed materials can be visualized, a method of preparation of a magnet is presented herein with the example of NdFeB first layer ferromagnetic material and a mixture of $CaF_2$ and $Y_2O_3$ as the resistive second layer material.

In one embodiment, a first layer 12 is formed by loading powder of the ferromagnetic material in a mold and compressing the powder to the desired density. While the initial green body density may vary depending on various factors such as the starting powder size and pressure of compression, it is often advantageous to obtain a magnet with a sintered density greater than about 96% of theoretical density. Therefore, in one embodiment, the ferromagnetic layer of the magnet has a sintered density greater than about 96% of the theoretical density of the ferromagnetic material.

The second layer 16 material may be formed in the form of granules. Granules may be formed by different methods. One method according to an embodiment of the present invention is freeze granulation. The freeze granulation method includes suspending the second layer powder material in a carrier fluid; spraying the thus formed suspension into a liquid at a temperature substantially below the freezing point of the carrier fluid to form frozen granules of the second layer materials, and then separating the frozen granules from the liquid, and freeze drying the granules. The $CaF_2$ and $Y_2O_3$ powders may be freeze granulated individually or in combination. In one embodiment, the carrier fluid used is water and the liquid used for freezing is liquid nitrogen.

The granules thus formed may be added to the mold and pressed to form the second layer 16 over the first, ferromagnetic layer 12. The freeze granulation process assists in preparing very fine, low density, separated powders of the second layer material and contributes to the formation of a thin, low-defect second layer 16 of resistive material over the first layer 12 of ferromagnetic material. Granules formed by other processes such as spray drying are typically higher density (lower porosity), and therefore when loaded into a die before pressing, form a thinner layer that is more easily bridged across by conductive magnet particles that may happen to fall on this layer during loading of the magnet powder above the resistive layer 16 or during subsequent processing.

The compressed, multilayered structure may be sintered to produce the magnet. In one embodiment of the invention, the sintering is performed within a temperature range from about 400° C. to about 1100° C., and for time duration of up to about 24 hours.

EXAMPLE

The following example illustrates methods, materials and results, in accordance with a specific embodiment, and as such should not be construed as imposing limitations upon the claims. All components are commercially available from common chemical suppliers.

80 volume % of yttrium oxide ($Y_2O_3$) and 20 volume % of calcium fluoride ($CaF_2$) powders were ball milled for 24 hours with ammonium citrate tribasic as a dispersant in water at a solid loading of about 8 volume percent using yttria-stabilized zirconia media. The resulting suspension was freeze granulated by spraying into liquid nitrogen and freeze drying. The resultant dry powder was calcined at a temperature of about 450° C. for about 1 hour in air to remove the ammonium citrate tribasic. The calcined powder was uniaxially pressed as an interlayer in between layers of NdFeB magnetic material powder. The resulting pellet was vacuum sealed in a polyethylene/aluminum foil bag and isostatically pressed at a pressure of about 35 ksi and sintered at a temperature of about 1100° C. for 1 hour under vacuum. A mechanically robust yttrium oxide/calcium fluoride resistive layer 16 was formed between layers 12, 14 of NdFeB magnetic material.

The mix of $Y_2O_3$ and $CaF_2$ and the sintering and cooling rates used in this experiment significantly mitigated the amount of cracking due to, for instance, thermal mismatch stresses and/or densification rate mismatch stresses, both of which can undermine the bonding between layers 12, 14, 16. The sintered thickness of NdFeB layers 12, 14 obtained was about 2 mm and the sintered thickness of the resistive layers 16 was approximately 100 microns.

The electrically resistive layers 16 formed by milling $Y_2O_3$ and $CaF_2$, freeze granulating, and pressing as layers between pressed layers of NdFeB 12, 14 followed by vacuum sintering bonded well with the NdFeB layers. The small resistive layer 16 thickness of around 100 microns compared to about 2 mm thick layers of NdFeB may help to keep the effect on magnet properties small while limiting eddy current losses. The electrically resistive layer 16 resists flow of eddy currents without substantially adversely affecting the magnetic properties of the magnetic material layers 12, 14. Magnets according to embodiments described herein may thus allow for more efficient electric motors, as could be used in hybrid automobiles.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A magnet, comprising:

a plurality of layers, wherein a first layer comprises a ferromagnetic material comprising iron and a rare earth element; and a second layer comprises an alkaline earth metal fluoride and a rare earth oxide, wherein the alkaline earth fluoride and the rare earth oxide are present in the second layer in an amount to form 100 volume % of the second layer, and wherein the alkaline earth metal fluoride is present in the second layer in an amount in a range from about 0.1 volume percent to about 80 volume percent of the second layer.

2. The magnet of claim 1, wherein the rare earth element is selected from the group consisting of gadolinium, terbium, erbium, dysprosium, scandium, yttrium, lanthanum, praseodymium, samarium, europium, holmium, thulium, ytterbium, lutetium, and neodymium.

3. The magnet of claim 1, wherein the ferromagnetic material comprises a boride compound.

4. The magnet of claim 3, wherein the ferromagnetic material comprises neodymium iron boride.

5. The magnet of claim 1, wherein the alkaline earth metal fluoride comprises calcium.

6. The magnet of claim 1, wherein the alkaline earth metal fluoride is present in the second layer in an amount in the range from about 10 volume percent to about 40 volume percent of the second layer.

7. The magnet of claim 1, wherein the plurality of layers comprise a plurality of repeating units, wherein a unit comprises the first layer and the second layer.

8. The magnet of claim 1, wherein the first layer has a thickness greater than 1 mm.

9. The magnet of claim 1, wherein the second layer has a thickness less than 500 microns.

10. The magnet of claim 9, wherein the thickness of the second layer is less than 200 microns.

11. An article comprising the magnet of claim 1.

12. The article of claim 11, wherein the article is a motor or a generator.

13. The magnet of claim 1, wherein the alkaline earth metal fluoride is present in the second layer in an amount to form 20 volume % of the second layer and the rare earth oxide is present in the second layer in an amount to form 80 volume % of the second layer.

14. A magnet, comprising:

a plurality of layers comprising a plurality of repeating units, wherein a unit comprises a first layer and a second layer, wherein the first layer comprises a ferromagnetic material comprising neodymium iron boride; and the second layer comprises calcium flouride and yttrium oxide, wherein the calcium flouride is present in the second layer in an amount to form 20 volume % of the second layer and the yttrium oxide is present in the second layer in an amount to form 80 volume % of the second layer.

* * * * *